United States Patent [19]

Groeneweg

[11] Patent Number: 4,667,651

[45] Date of Patent: May 26, 1987

[54] PORTABLE OUTDOOR COOKING APPARATUS

[76] Inventor: Ronald L. Groeneweg, 232-6th Ave. SE., Sioux Center, Iowa 51250

[21] Appl. No.: 816,354

[22] Filed: Jan. 6, 1986

[51] Int. Cl.[4] ..... F24B 3/00

[52] U.S. Cl. ..... 126/25 R; 126/25 A

[58] Field of Search ..... 126/25 R, 25 A

[56] References Cited

U.S. PATENT DOCUMENTS

| | | | |
|---|---|---|---|
| 2,666,426 | 1/1954 | Pollard | 126/25 R |
| 3,217,634 | 11/1965 | Fox | 126/25 A |
| 3,330,266 | 7/1967 | Stephen | 126/25 R |
| 4,026,266 | 5/1977 | Cremer | 126/25 A |

*Primary Examiner*—Carroll B. Dority, Jr.
*Attorney, Agent, or Firm*—David C. Larson

[57] ABSTRACT

A portable outdoor cooking apparatus is provided. The preferred embodiment consists of a conical shaped base unit with a round, flat fire-pit area located in the lower portion of the cone. The ground beneath the outdoor cooking apparatus is protected by means of a heat baffle and two air spaces. The top of the conical shaped base is encircled by a ring to promote diffusion of the heat in the unit. An adjustable grill surface is also provided for cooking or it can be removed to allow open fire cooking. The portable outdoor cooking apparatus is equally adaptable to charcoal or wood, as well as a variety of other combustible materials.

5 Claims, 2 Drawing Figures

PORTABLE OUTDOOR COOKING APPARATUS

BACKGROUND OF THE INVENTION

The present invention relates generally to outdoor cooking apparatuses, and more particularly to a portable cooking apparatus adaptable to grilling, as well as open-fire cooking, for use with either charcoal, wood, or other similar combustible fuel.

Those concerned with outdoor cooking and recreation, particularly those involved with resorts, campgrounds, or recreational parks, have long been familiar with the difficulties involved in providing outdoor cooking for their patrons. Typically, family resorts, campgrounds, recreational parks, and like facilities are equipped with stone or metal fireplaces for charcoal grilling or with fire-pit areas for campfire cooking. These typical cooking devices have served adequately, but they lack the versatility and uniqueness of the present invention.

The various patrons have a variety of different interests regarding the outdoor cooking they enjoy when vacationing or while on an afternoon outing. Generally, in the more developed areas, patrons are provided with access to either charcoal or gas grills, and in the more primitive areas, they have been provided with access to open fire-pits, but until the present invention, they have not been able to choose the type of outdoor cooking at a given facility. The better developed areas tend to promote gas or charcoal cooking to protect against damage to the grounds from open-flame cooking. The less developed areas tend to promote open-flame cooking to avoid the expense of providing enclosed grills. The present invention provides both charcoal or wood cooking and promotes the aesthetics of the recreation area.

Similarly, the individual or family consumer is often limited to the type of outdoor cooking available, because of typical residential regulations barring open burning or open-flame cooking. In the past, these consumers have been limited to choosing between the various models of charcoal or gas grills, and have not had access to open-fire cooking due to the possibility of scorching the surrounding lawn area.

In the past, many different types of cookers have been developed for outdoor barbecuing, but they have been limited to a particular type of cooking, based upon the area of use for which they were designed. With the increased competition for patrons in resort and recreation areas, as well as the individual desire for variety, there is a need for an inexpensive and adaptable outdoor cooking apparatus.

SUMMARY OF THE INVENTON

Accordingly, the present invention provides an outdoor cooking apparatus for commercial use, as well as individual barbecuing.

An object of the present invention is to provide an outdoor cooking apparatus adaptable to both open-fire cooking and charcoal cooking.

Another object is to provide an outdoor cooking device with a heat baffle to protect the ground or grass located beneath the firebox.

A further object of the invention is to provide an outdoor cooking device that diffuses heat from the perimeter of the apparatus, thereby providing safer use.

Yet another object is to provide an outdoor cooking apparatus which is not complicated to use.

Other objects, advantages, and novel features of the present invention will become apparent from the following detailed description of the invention, when considered in conjunction with the accompanying drawings.

DESCRIPTION OF THE PREFERRED EMBODIMENT

Figure 1:
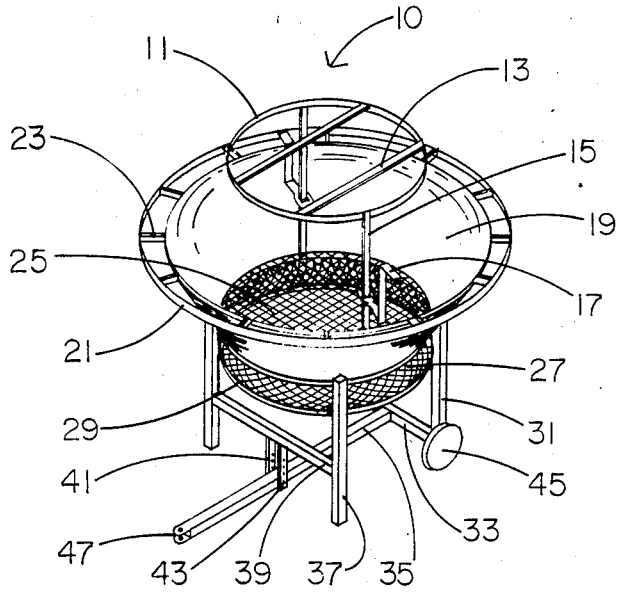
FIG. 1 is an isometric view showing the outdoor cooking apparatus of the present invention.

Referring now the drawings wherein like reference numerals designate identical or corresponding parts throughout the views, FIG. 1 shows the outdoor cooking apparatus of the present invention indicated generally at 10.

In the preferred embodiment, the outdoor cooking apparatus 10 consists of a removable grate 25 located near the bottom of an upward opening conical fire wall 19. The grate 25 is shown in FIG. 1 in a webbing configuration, but it is understood that generally parallel bars or the like as well known in the art would be equally acceptable for the grate 25. Additionally, the conical configuration of the fire wall 19 would be equally functional in a kettle shaped configuration or the like. The outer perimeter of the firebox 19 is provided with spacers 23 to hold a heat diffuser 21 around the outside perimeter of the cooking apparatus 10. The heat diffuser serves to provide a cooler exposed surface as well as to provide a place to hang barbecue utensils.

Figure 2:
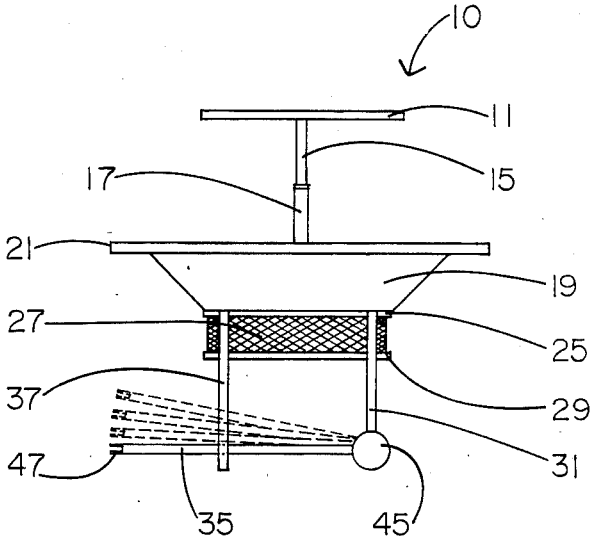
FIG. 2 is a side elevation view showing the outdoor cooking apparatus of the present invention.

As best seen in FIG. 2, there is a heat baffle 29 located beneath the grate 25 for catching the ashes from the fire and preventing them from falling to the ground. The heat baffle 29 consists of a metal shell surrounding a non-flamable heat insulating material, such as sand, light weight concrete, or the like. In order to retard overflow of ashes and embers over the edge of the heat baffle 29, and to promote air flow to the lower part of the grate 25, a cylindrical screen 27 encircles the space between the bottom of the fire wall 19 and the top of the heat baffle 29.

The outdoor cooking apparatus 10 is provided with an adjustable and removeable grill frame 11 and grill supports 13 for accomodating a standard barbecue grill (not shown) as well known in the art. The grill frame is mounted on adjustable telescoping supports 15, which are locked at the desired height through the use of friction locks 17. It is understood that telescoping supports are well known in the art, and that other configurations such as appurature and pin, exterior locking threaded sleeve or the like would be equally functional to lock the telescoping supports 15 at the desired height.

The outdoor cooking apparatus 10 is mounted on rear support legs 31 and front support legs 37 in order to provide clearance above the ground and an additional air space to minimize heat damage to the ground below. For stability the rear support legs 31 are connected by a rear stabilizer 33 and the front support legs 37 are connected by a front stabilizer 39. An Alternative tripod embodiment (not shown) is equally functional, with two rear support legs and one front support leg. An adjustable tongue 35 is pivotally mounted to rear stabilizer 33 for use in pulling the apparatus 10 either by hand or behind a garden tractor. An apertured tongue lock 41 extends downward from front stabilizer 39 to adjustably fix the vertical angle of the tongue 35. The tongue 35 is provided with oval shaped apertures (not shown) which align with the apertures in the tongue lock 41 allowing the tongue to be fixed in place through insertion of pin 43.

Mobility of the apparatus 10 is realized by lifting the front support legs 37 off of the ground and manuevering the apparatus 10 on the wheels 45 which are rotatably mounted on the rear support legs 31. A clevis hitch 47 is provided at the front of the tongue to facilitate connection to a garden tractor or similar draft vehicle.

I claim:

1. An outdoor cooking apparatus comprising:

a conical shaped fire wall opening upward;

a heat diffuser mounted around the top perimeter of the fire wall;

a removable grate located within the bottom of the fire wall for holding charcoal or firewood;

a heat baffle affixed below the grate;

a vertical band of screen enclosing the air space between the grate and the heat baffle;

a plurality of support legs extending downward from the exterior of the fire wall for holding the cooking apparatus off of the ground;

a pair of locking telescoping supports extending upward from opposing points adjacent to the perimeter of the grate; and a circular frame attached to the top of telescoping supports for supporting a standard grill.

2. An outdoor cooking apparatus as recited in claim 1 further comprising:

a wheel rotatably mounted on each rear support leg for rolling the outdoor cooking apparatus between desired locations.

3. An outdoor cooking apparatus as recited in claim 2 further comprising:

a tongue attached to the lower portion of the outdoor cooking apparatus for maneuvering the apparatus.

4. An outdoor cooking apparatus as recited in claim 3 wherein said heat baffle comprises:

a metal shell encasing a non-flamable heat insulating material.

5. An outdoor cooking apparatus comprising:

a conical shaped fire wall opening upward, and open at both the bottom and top;

a heat diffuser mounted around the top perimeter of the fire wall;

a grate horizontally disposed within the bottom of the fire wall for holding charcoal or firewood;

a heat baffle affixed below the grate consisting of a metal shell encasing a non-flamable heat insulting material;

a vertical band of screen enclosing the air space between the grate and the heat baffle;

a plurality of support legs extending downward from the exterior of the fire wall for holding the cooking apparatus off of the ground;

a pair of wheels ratatably attached to the rear support legs for rolling the outdoor cooking apparatus between desired locations;

a rear stabilizer extending between the two rear support legs;

a tongue swivelly attached to the rear stabilizer;

locking means for maintaining the tongue at a desired angle;

a pair of locking telescoping supports extending upward from opposing points on the perimeter of the grate; and a horizontal circular frame attached to the telescoping supports at two opposing points on it's perimeter for supporting a standard charcoal grill.

* * * * *